US007578426B2

(12) United States Patent
Wende et al.

(10) Patent No.: US 7,578,426 B2
(45) Date of Patent: Aug. 25, 2009

(54) FOLDING BAG

(75) Inventors: Lucien Wende, Mosbach (DE); Ralf Kenner, Bietigheim (DE)

(73) Assignee: CD Cartondruck AG, Obersulm (DE)

( * ) Notice: Subject to any disclaimer, the term of this patent is extended or adjusted under 35 U.S.C. 154(b) by 384 days.

(21) Appl. No.: 10/565,269

(22) PCT Filed: Jul. 16, 2004

(86) PCT No.: PCT/DE2004/001552

§ 371 (c)(1),
(2), (4) Date: Jan. 20, 2006

(87) PCT Pub. No.: WO2005/026000

PCT Pub. Date: Mar. 24, 2005

(65) Prior Publication Data

US 2006/0219761 A1 Oct. 5, 2006

(30) Foreign Application Priority Data

Aug. 30, 2003 (DE) ..... 203 13 482

(51) Int. Cl.
*B65D 3/10* (2006.01)

(52) U.S. Cl. ..... 229/4.5; 229/5.5; 229/122.31

(58) Field of Classification Search ..... 229/122.28, 229/122.29, 116.1, 128, 125.02, 902
See application file for complete search history.

(56) References Cited

U.S. PATENT DOCUMENTS 2,326,648 A 8/1943 Horr
5,911,358 A * 6/1999 Kenner et al. ..... 229/116.1
6,152,359 A * 11/2000 Clark ..... 229/117.04
6,170,740 B1 * 1/2001 Clark ..... 229/117.04
6,513,704 B1 * 2/2003 Perot ..... 229/104

FOREIGN PATENT DOCUMENTS

EP 0 879 766 A1 11/1998
JP 10-35725 A 2/1998

OTHER PUBLICATIONS

International Preliminary Report on Patentability in PCT/DE04/01552, dated Jul. 3, 2006.
Written Opinion of the International Searching Authority in PCT/DE04/01552, dated Jul. 3, 2006.

* cited by examiner

*Primary Examiner*—Gary E Elkins
*Assistant Examiner*—Christopher Demeree
(74) *Attorney, Agent, or Firm*—Venable LLP; Robert Kinberg; Ryan M. Flandro

(57) ABSTRACT

A folded box has side walls and a base unit and/or a lid unit. At least one of the side walls has a convex curvature when the folded box is folded up. At least one supporting unit is connected to the inner wall of the convexly curved side wall and has a first adhesive tab and a second adhesive tab, which are connected to the inner wall and which are arranged spaced apart from each other in the direction of the curvature. Between the first and second adhesive tab there is a supporting tab, which is connected to the first and the second adhesive tab via a first and a second supporting tab fold, respectively. The length of the supporting tab corresponds to the distance between the first and the second adhesive tab. When the box is folded up, the supporting tab can be folded into the interior of the folded box or, folded up automatically into the interior of the folded box.

16 Claims, 15 Drawing Sheets

FOLDING BAG

CROSS REFERENCE TO RELATED APPLICATIONS

This application is a National Stage Application of International Application No. PCT/DE2004/001552, filed Jul. 16, 2004, which claims priority to German Patent Application 203 13 482.6, filed Aug. 30, 2003, the subject matter of which is hereby incorporated by reference.

BACKGROUND OF THE INVENTION

1. Field of the Invention

The present invention relates to a folded box having side walls and a base unit and/or a lid unit, at least one side wall having a convex curvature when the folded box is folded up.

Folded boxes of this type are used in large numbers, for example for packaging products from the cosmetic and/or pharmaceutical industry.

2. Description of the Related Art

Folded boxes of an extremely wide range of types are known. In the European patent application EP 0 879 766 A1, a folded box of the type mentioned at the beginning is described which has two opposite, convexly curved side walls and an oval cross-sectional contour.

SUMMARY OF THE INVENTION

The present invention is based on the technical problem or the object of specifying a folded box of the type mentioned at the beginning which can be produced economically, can be folded into a flat state for transport to the filler, can be folded up simply and ensures safe preservation of the packaged object. Furthermore, it should be possible to use a simple base unit, at the same time ensuring a high loadbearing capacity. Furthermore, the folded box is to offer the possibility of securing the lid unit against unintentional opening.

The folded box according to the invention is accordingly distinguished by the fact that at least one supporting unit is connected to the inner wall of the convexly curved side wall and has a first adhesive tab and a second adhesive tab, which are connected to the inner wall and which are arranged spaced apart from each other in the direction of the curvature, and between the first and second adhesive tab there is a supporting tab, which is connected to the first and, respectively, the second adhesive tab via a first and, respectively, a second supporting tab fold, the length of the supporting tab corresponding to the distance between the first and the second adhesive tabs and, when the folded box is folded up, it being possible for the supporting tab to be folded into the interior of the folded box or, when the folded box is folded up, folding up automatically into the interior of the folded box.

In an exemplary embodiment, there can be a plurality of supporting units beside one another in the direction of the curvature.

A folded box which is particularly compact, can be folded up simply and ensures a high loadbearing capacity is distinguished by the fact that the folded box has two convexly curved side walls which, when folded up, are opposite each other, so that the result is an oval or round cross-sectional shape, and opposite supporting units are arranged on the inside of the side walls.

In a first embodiment, the supporting tab has a convex curvature into the interior of the folded box when folded up.

The supporting tab has at least one further supporting tab fold, which runs parallel to the first and, respectively, the second supporting tab fold and, in particular, is arranged centrally on the supporting tab. As a result of providing a further supporting tab fold, the folding operation is made easier.

The supporting tab is formed with double walls, which firstly results in increased load bearing and secondly, because of the high stiffness of the double-walled supporting tab, ensures that the supporting tab is folded up automatically into the interior of the folded box when the entire folded box is folded up.

According to an exemplary embodiment, the supporting tab is arranged directly underneath the base unit and/or directly above the lid unit.

With regard to the production of a folded box from a one-piece blank, the base unit and/or the lid unit is connected to the inner wall of a side wall element via a base fold and a lid fold, respectively, the base fold and lid fold being arranged substantially at the same height as the upper and lower edge, respectively, of the folded-up supporting tab.

To ensure a particularly simple folding operation and permit secure positioning of the lid unit and the base unit, the base unit and the lid unit are provided with a base adhesive tab and a lid adhesive tab, respectively, which are connected to the respective side wall via a base adhesive tab fold and a lid adhesive tab fold and which are connected to the inside of the corresponding side wall.

With regard to the already mentioned one-piece blank for the folded box, the first and second adhesive tabs of the supporting unit are integrally molded on the lower and/or upper front end edge of a side wall element via a first and a second adhesive tab fold, respectively, and there is a slot between the side wall and supporting tab. In this case, the double-walled nature of the supporting tab can be implemented simply in a constructional manner, according to an exemplary embodiment, in that there is at least one reinforcing tab connected to the supporting tab via a reinforcing tab fold, the reinforcing tab fold running parallel to the first and the second adhesive tab folds, respectively.

With respect to the stability of the entire folded box, the base unit and/or the lid unit have an external circumferential contour which corresponds substantially to the inner circumferential contour, formed by the curved side walls, of the folded box.

In order to increase the loadbearing capacity, the base unit and/or the lid unit can be double-walled.

The material used for the folded box and the blank is preferably board or board-like material or plastics material.

Further embodiments and advantages of the invention emerge through the exemplary embodiments specified below.

BRIEF DESCRIPTION OF THE SEVERAL VIEWS OF THE DRAWINGS

The invention and advantageous embodiments and developments of the same will be described and explained in more detail in the following text by using the examples illustrated in the drawing. The features to be gathered from the description and the drawing can be used individually on their own or in a plurality in any desired combination according to the invention. In the drawing.

DETAILED DESCRIPTION OF THE INVENTION

FIGS. 1 to 5 illustrate details of a convexly outwardly curved side wall 12 of a folded box, not specifically illustrated. The interior of the (folded-up) folded box is provided with the designation 48.

Figure 1:
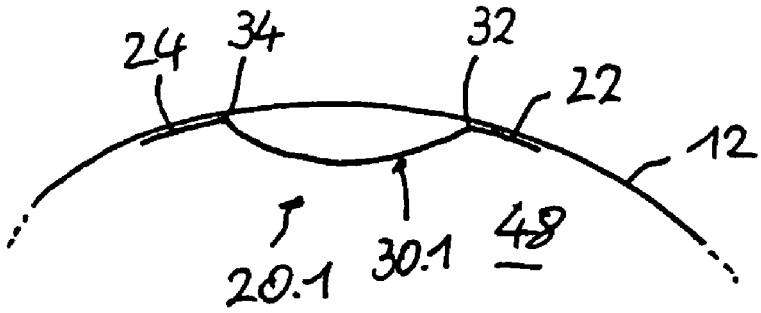
FIGS. 1 to 5 show a detailed cross section of a convexly curved side wall of a folded box with in each case a differently constructed supporting unit folded up into the interior of the folded box.

In the exemplary embodiment according to FIG. 1, there is on the inner wall of the side wall 12 a supporting unit 20.1, which is adhesively bonded to the inner wall of the side wall 12 via a first adhesive tab 22 and a second adhesive tab 24 arranged spaced apart in the direction of the curvature (circumferential direction). By means of a first supporting tab fold 32 and by means of a second supporting tab fold 34, a supporting tab 30.1 is integrally molded in one piece between the two adhesive tabs 22, 24 and is folded in a convexly curved manner into the interior 48 of the folded box. The first adhesive tab fold 26 and the second adhesive tab fold 28 run at right angles to the plane of the page.

Figure 2:
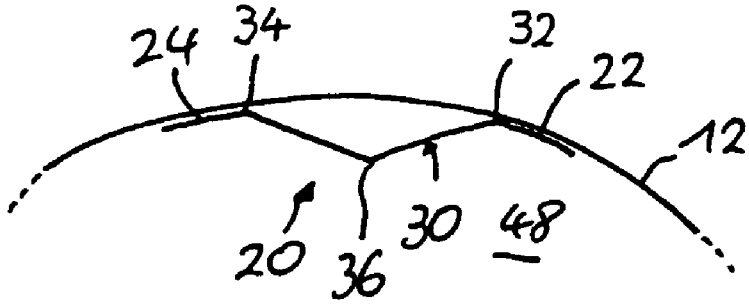

The second exemplary embodiment according to FIG. 2 differs from the exemplary embodiment according to FIG. 1 in that there is a supporting unit 20 which has a supporting tab 30 which has a further supporting tab fold 36 at the center, such that the supporting tab 30 projects into the interior 48 of the folded box in the form of the point of a triangle when folded up.

Figure 3:
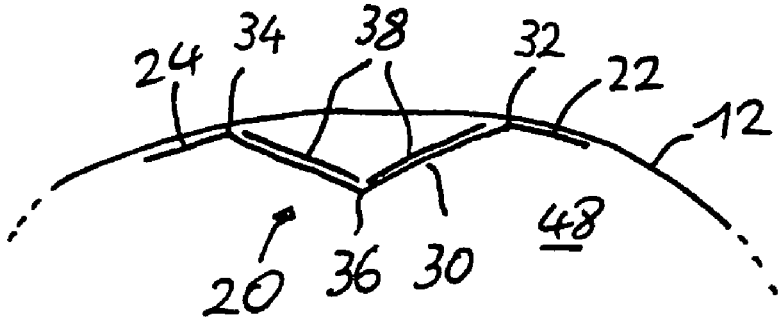

In the third exemplary embodiment according to FIG. 3, the supporting unit 20 has two reinforcing tabs 38, which are adhesively bonded to the supporting tab 30.

Figure 4:
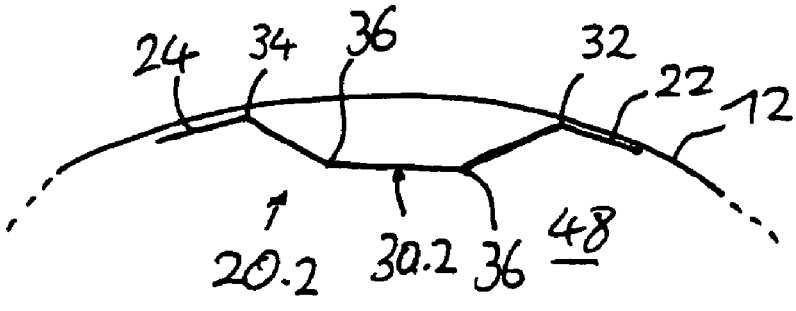

In the fourth exemplary embodiment according to FIG. 4, a supporting unit 20.2 is illustrated of which the supporting tab 30.2 has two further supporting tab folds 36 arranged spaced apart from each other, so that the folded-up supporting tab 30.2 assumes a polygonal course.

Figure 5:
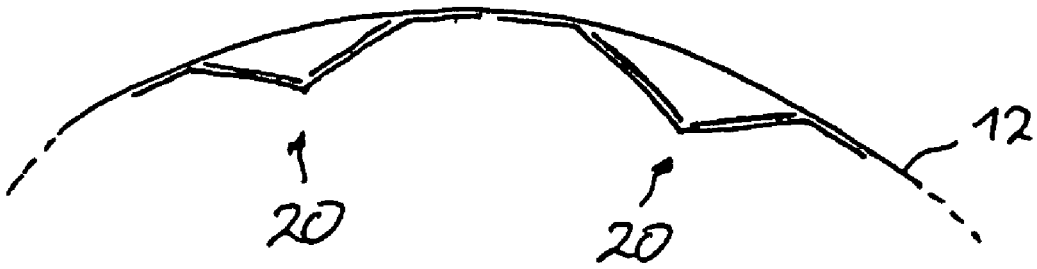

FIG. 5 shows an alternative refinement, in which two supporting units 20 arranged beside each other are connected to the inner wall of the side wall 12.

Figure 6:
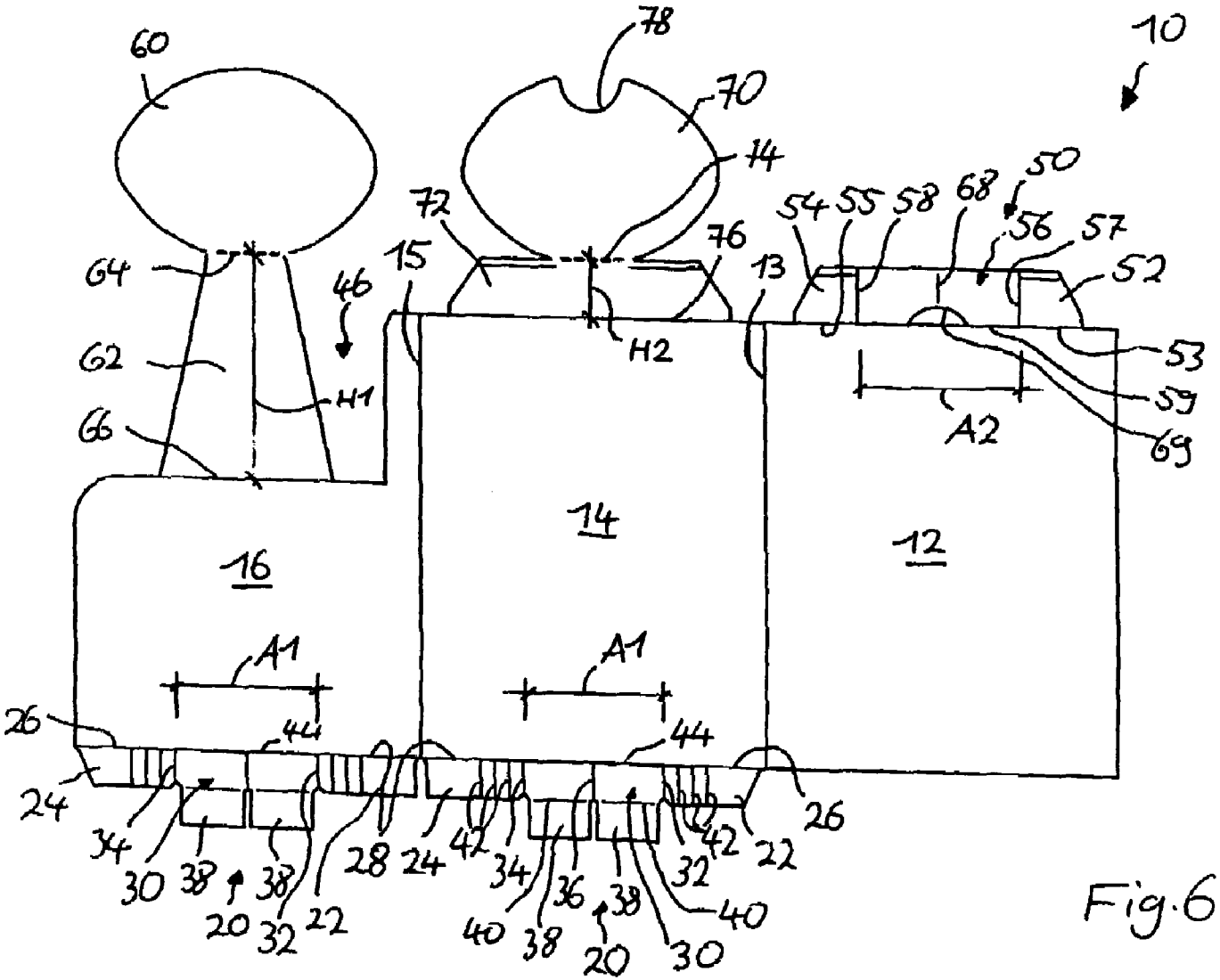
FIGS. 6 to 16 show a schematic elevation of the blank of an exemplary embodiment of a folded box having supporting units in different folded states of the blank, namely from the original blank (FIG. 6) as far as the flat-folded transport state of the folded box (FIG. 16)

In FIG. 6 the blank of a folded box 10 is illustrated in the unfolded state in an outside view.

The folded box 10 has a first rectangular side wall 12, on which a second side wall 14 is integrally molded via a first side wall fold 13. On the longitudinal edge of the second side wall 14 opposite the first side wall fold 13, an inner wall 16 is integrally molded via a second side wall fold 15. In the folded-up state, the first side wall 12 and the second side wall 14 form a convexly outwardly curved circumferential contour.

Integrally molded on the lower front longitudinal edge of the second side wall 14 is a supporting unit 20, which will be described in the following text. The supporting unit 20 has a first adhesive tab 22 and a second adhesive tab 24, in each case in the left-hand and right-hand edge region. The two adhesive tabs 22, 24 are in each case integrally molded on the second side wall 14, respectively via a first adhesive tab fold 26 and a second adhesive tab fold 28. The clear space between the two adhesive tabs 22, 24 is designated A1 in FIG. 6. In this region of the space A1, a supporting tab 30 is integrally molded on the first adhesive tab 22 via a first supporting tab fold 32 and on the second adhesive tab 24 via a second supporting tab fold 34, there being a slot 44 between the supporting tab 30 and the second side wall 14. The two supporting tab folds 32, 34 run at right angles to the adhesive tab fold 26, 28. Centrally, the supporting tab 30 has a continuous further supporting tab fold 36 running parallel to the supporting tab folds 32, 34.

In the region between the further supporting tab fold 36 and the first adhesive tab fold 26 and the second adhesive tab fold 28, respectively, a reinforcing tab 38, which has substantially the same surface contour as the respective half supporting tab 30, is integrally molded on the lower longitudinal edge of the supporting tab 30, via a reinforcing tab fold 40 in each case.

In the end region of the first adhesive tab 22 and the second adhesive tab 24 which adjoins the first adhesive tab fold 26 and the second adhesive tab fold 28, respectively, in each case three further embossed folds 42 are molded in parallel to the adhesive tab folds 26, 28, which ensure good adaptation of the first and the second adhesive tabs 22, 24 to the second side wall 14 which is curved convexly when folded up.

Integrally molded on the lower front edge of the inner side wall 16 is a further supporting unit 20, which has the same design construction as the above-described supporting unit 20, so that it is possible to dispense with its repeated description.

Integrally molded on the upper front longitudinal edge of the first side wall 12 is a further supporting unit 50 which, in principle, apart from the reinforcing tabs 38, has the same construction as the above-described supporting unit 20 but with different geometric dimensions. Here, too, a first adhesive tab 52 and a second adhesive tab 54 arranged at a distance A2 are in each case integrally molded on the first side wall 12, via a first adhesive tab fold 53 and a second adhesive tab fold 55, respectively. In the region of the space A2, a supporting tab 56 is integrally molded on the first adhesive tab 52 and the second adhesive tab 54, via a first supporting tab fold 57 and a second supporting tab fold 58, respectively.

Between the supporting tab 56 and the upper front edge of the first side wall 12 there is likewise a slot 59. Centrally, the supporting tab 56 has a further supporting tab fold 68 and a cutout 69 which is arranged centrally on the lower edge region of the supporting tab 56 and is open toward the slot 59.

On the upper front longitudinal edge of the second side wall 14, a lid adhesive tab 72 is integrally molded in one piece via a lid adhesive tab fold 76. In the edge region of the lid adhesive tab 72 opposite the lid adhesive tab fold 76, a lid unit 70 is integrally molded in one piece via a lid fold 74. In its upper edge region, the lid unit 70 has a partly circular cutout 78 which is open at the top.

At its top, the inner side wall 16 has a cutout 46 which is open at the top and on the left, in such a way that a virtually square inner side wall region is formed in the lower region, in which there results a strip-like region at the top along the second side wall fold 15.

In the upper front edge region of the square area region of the inner side wall 16, a base adhesive tab 62 that tapers trapezoidally at the top is integrally molded in one piece via a base adhesive tab fold 66, on which base adhesive tab 62 a base unit 60 is integrally molded in one piece at the top via a base fold 64. The inner side wall 16, the second side wall 14 and the first side wall 12 have substantially the same width. Both the base unit 60 and the lid unit 70 are oval in terms of their external contour, the geometry being chosen such that, when the folded box is folded up, the side walls 12, 14 and, respectively, 16 rest in a convexly curved manner in terms of their internal contour.

The spacing of the base adhesive tab fold 66 from the base fold 64, that is to say the length H1 of the base adhesive tab 62, is dimensioned such that, when the base adhesive tab 62 is folded over inward around the base adhesive tab fold 66, the base fold 64 is arranged in the immediate region of the upper edge of the supporting unit 20 when the latter is folded inward.

The spacing of the lid adhesive tab fold 76 from the lid fold 74, that is to say the length H2 of the lid adhesive tab 72, is dimensioned such that, when the lid adhesive tab 72 is folded over inward around the lid adhesive tab fold 76, the lid fold 74 is arranged in the immediate edge region of the supporting tab 56 folded over inward.

In the following text, the individual folding operations for folding the unfolded blank as far as the flat transport state of the folded box will be described by using FIGS. 7 to 16.

Figure 7:
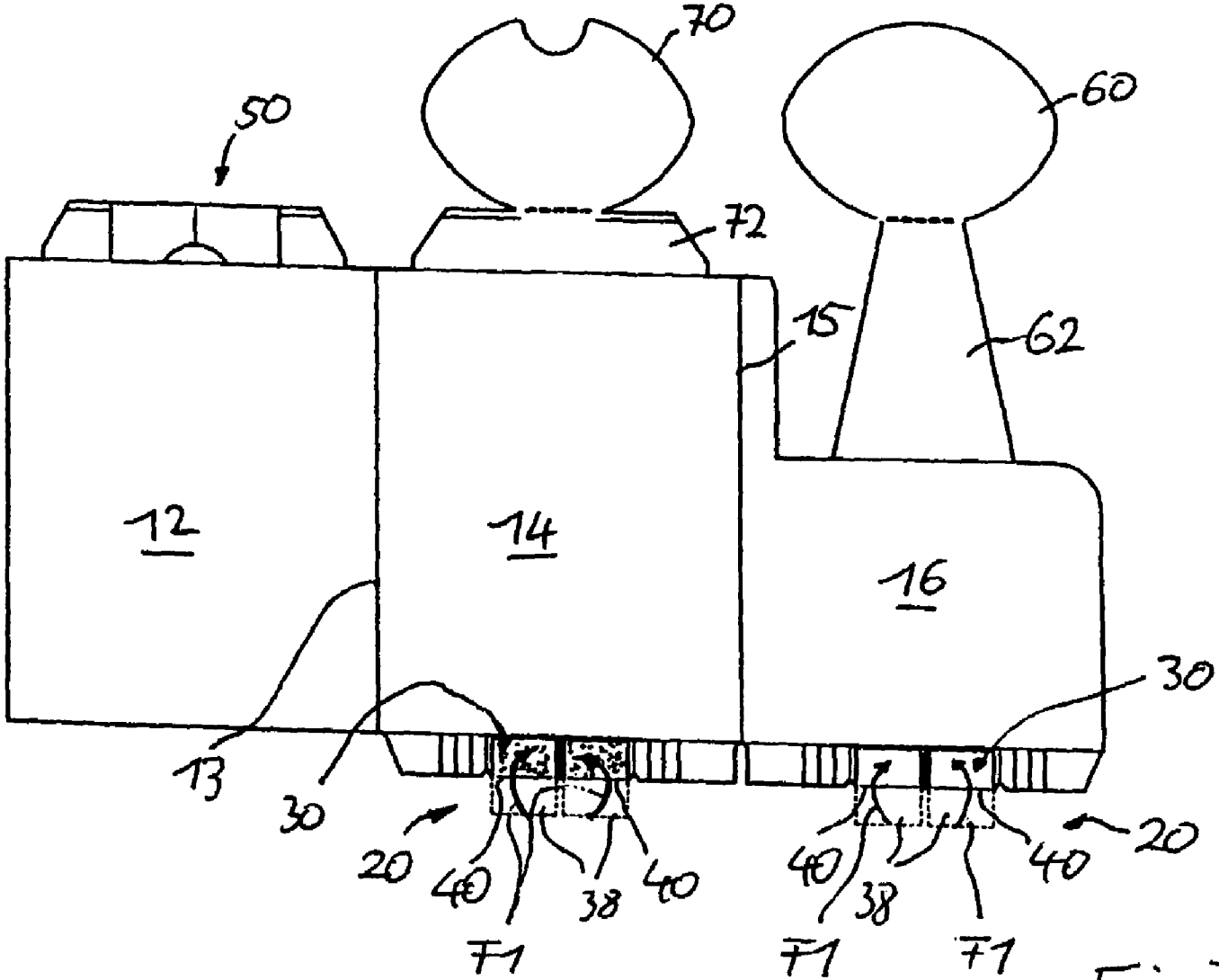

FIG. 7 shows a view of the blank, seen from the inner side of the folded box to be folded, that is to say a blank rotated through 180° with respect to the illustration in FIG. 6. Here, as early as in a first folding operation, the reinforcing tabs 38 have been folded around inward onto the supporting tabs 30 of the supporting unit 20 (arrows F1) along the respective reinforcing tab folds 40 and have been adhesively bonded to these (adhesive areas illustrated dotted).

Figure 8:
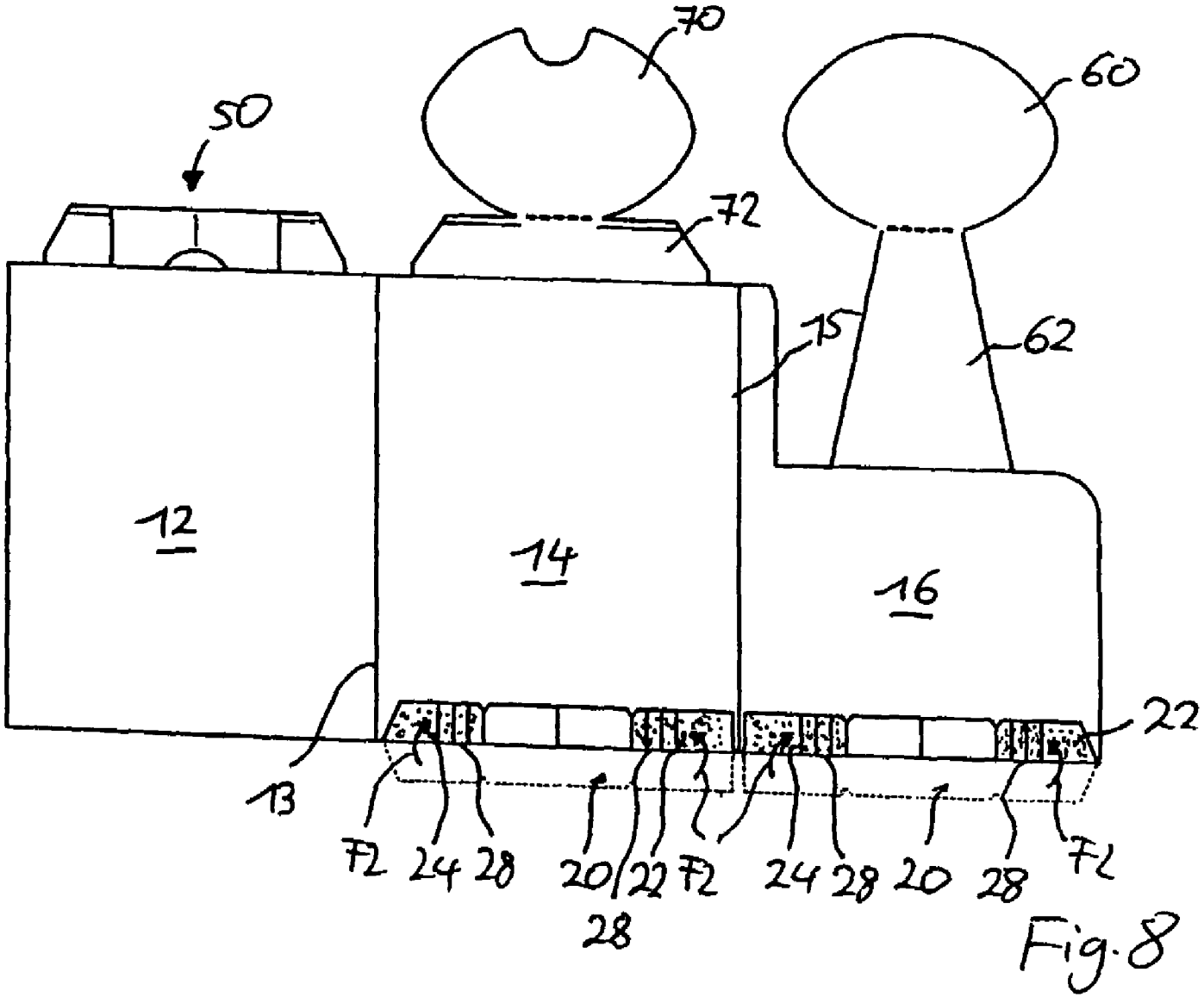

In the next step, according to FIG. 8, the two supporting units 20 are folded around inward along the first and second adhesive tab folds 26, 28, the first and second adhesive tabs 22, 24, being adhesively bonded to the inner wall of the second side wall 14 and the inner side wall 16, respectively (adhesive areas illustrated dotted, arrows F2).

Figure 9:
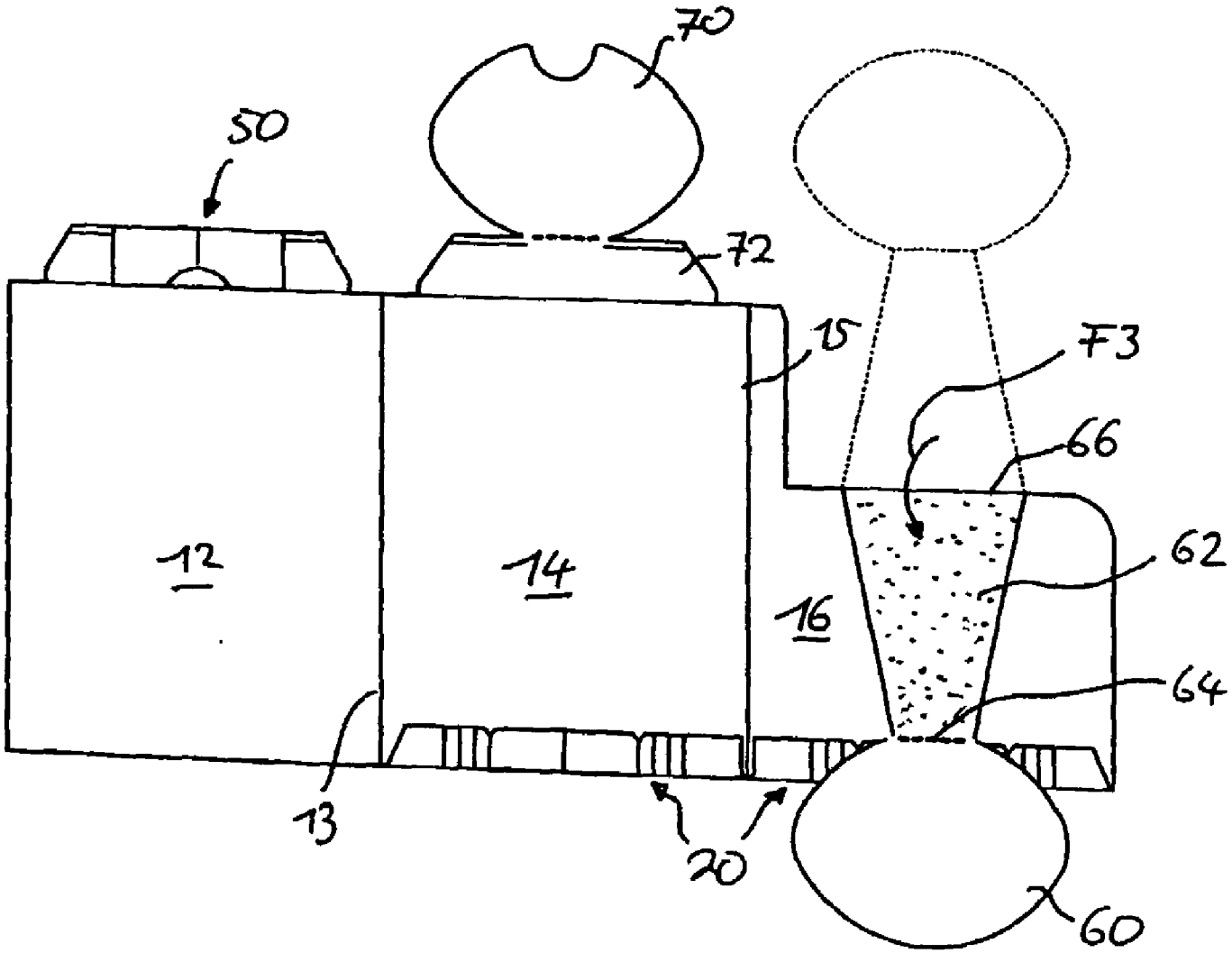

In the next folding operation, according to FIG. 9, the base adhesive tab 62 is folded over inward around the base adhesive tab fold 66 and adhesively bonded to the inside of the inner side wall 16 (adhesive areas illustrated dotted, arrow F3). As can be seen from FIG. 9, in this state the base fold 64 is arranged in the immediate vicinity of the upper edge of the supporting unit 20.

Figure 10:
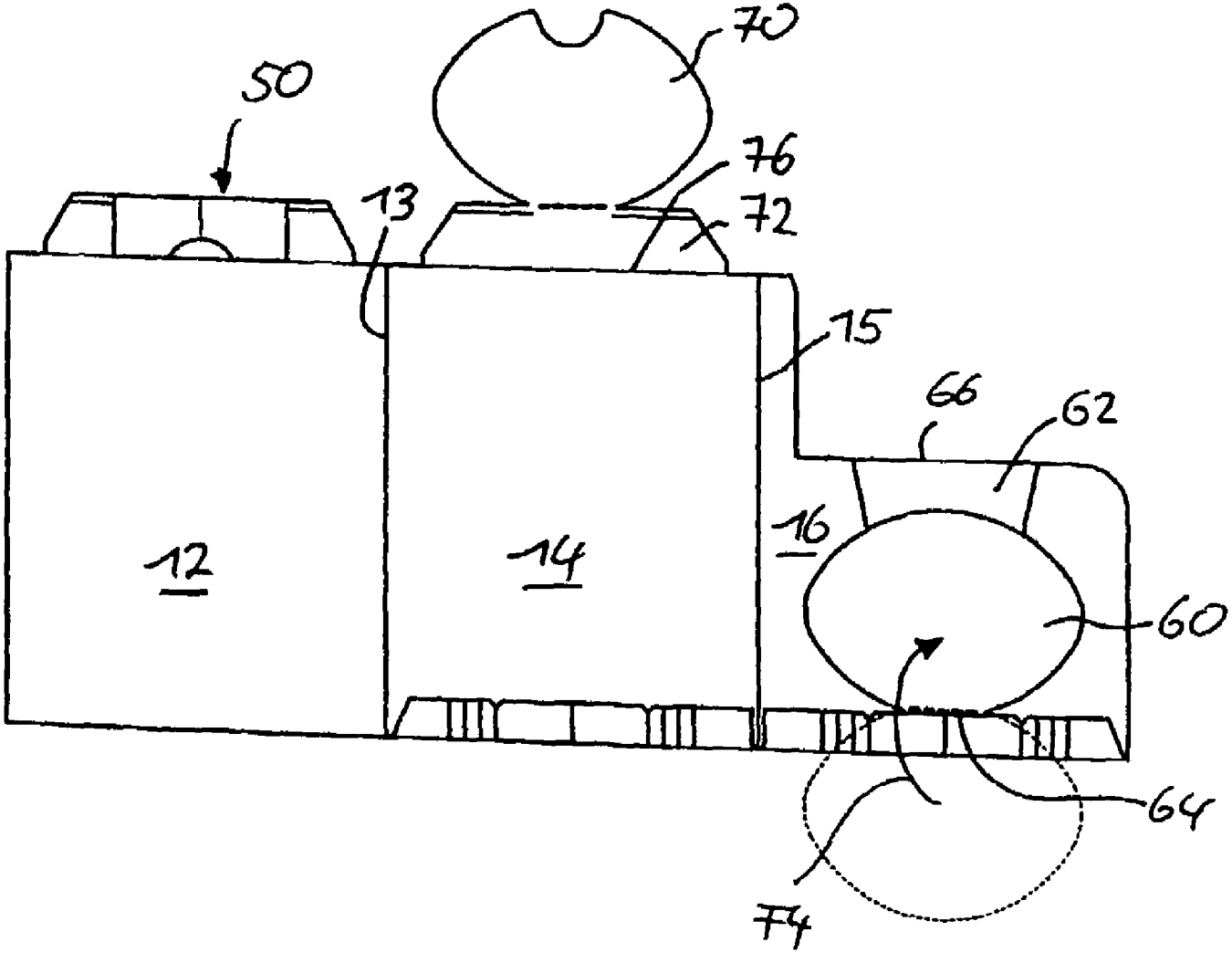

In the next step, according to FIG. 10, the base unit 60 is folded (upward) inward around the base fold 64 (arrow F4).

Figure 11:
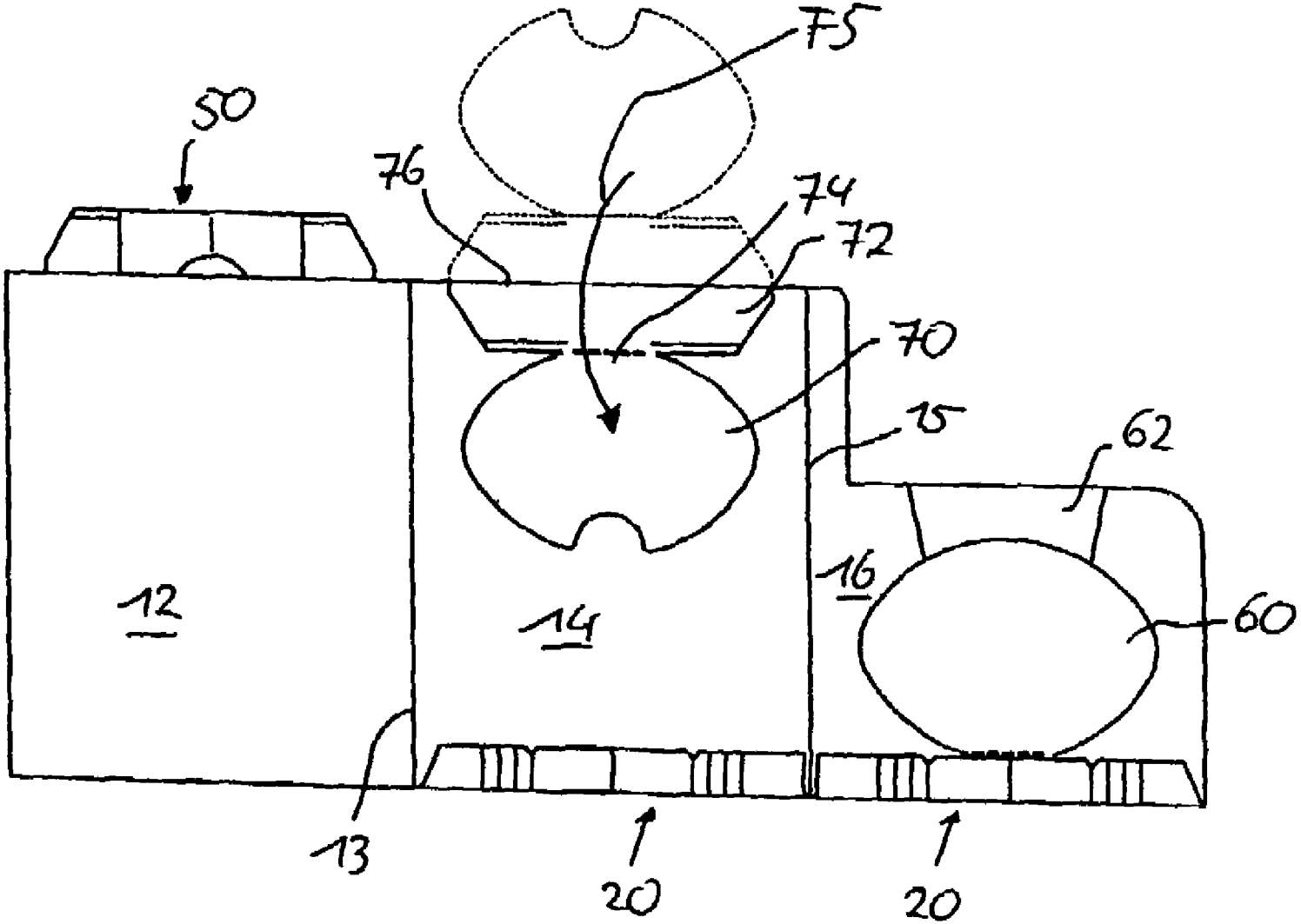
Figure 12:
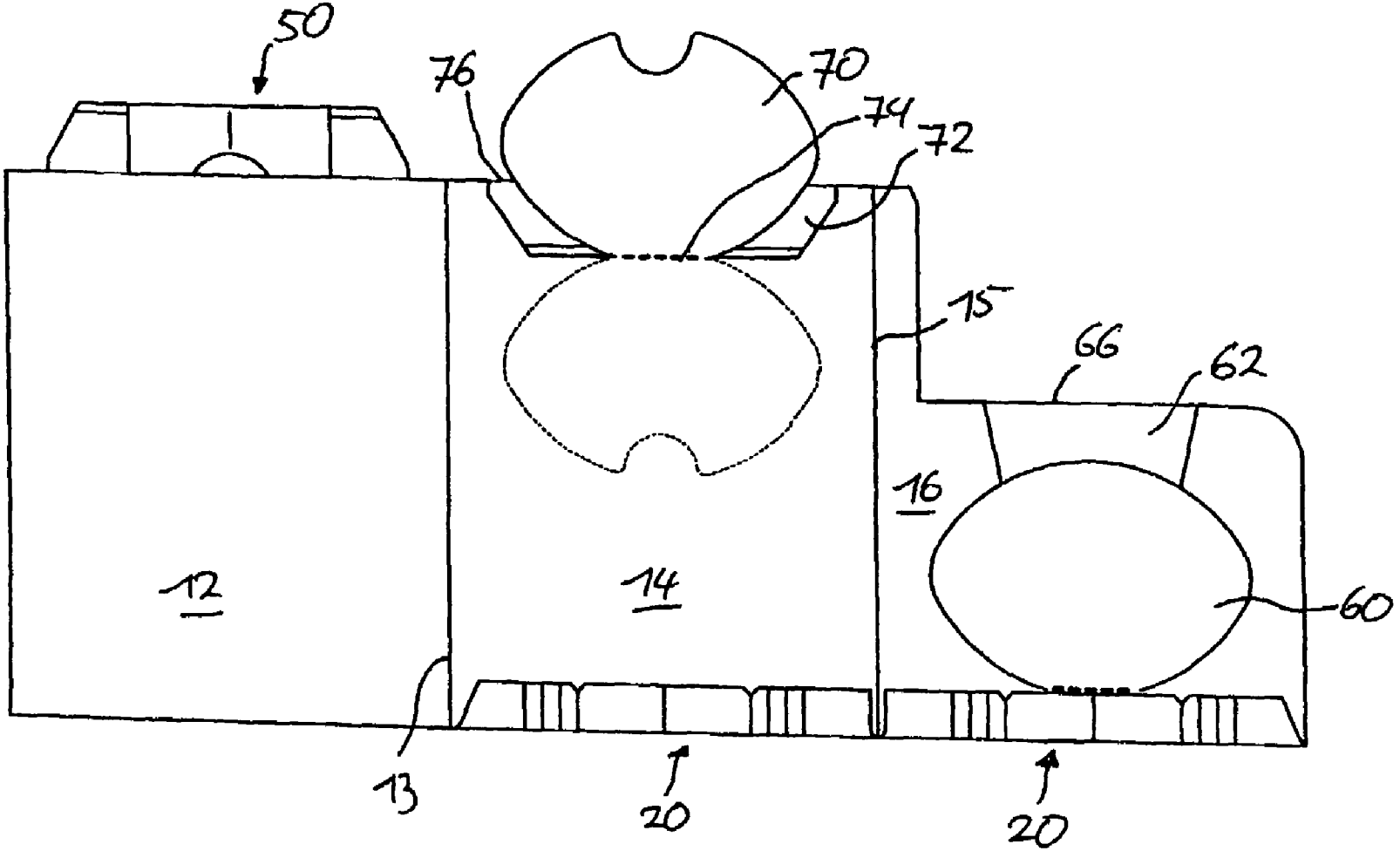

In the next folding step, according to FIG. 11, the lid adhesive tab 72 with the lid unit 70 is folded (downward) inward around the lid adhesive tab fold 76 (arrow F5). Following this, the lid unit 70 is folded upward around the lid fold 74 (see FIG. 12).

Figure 13:
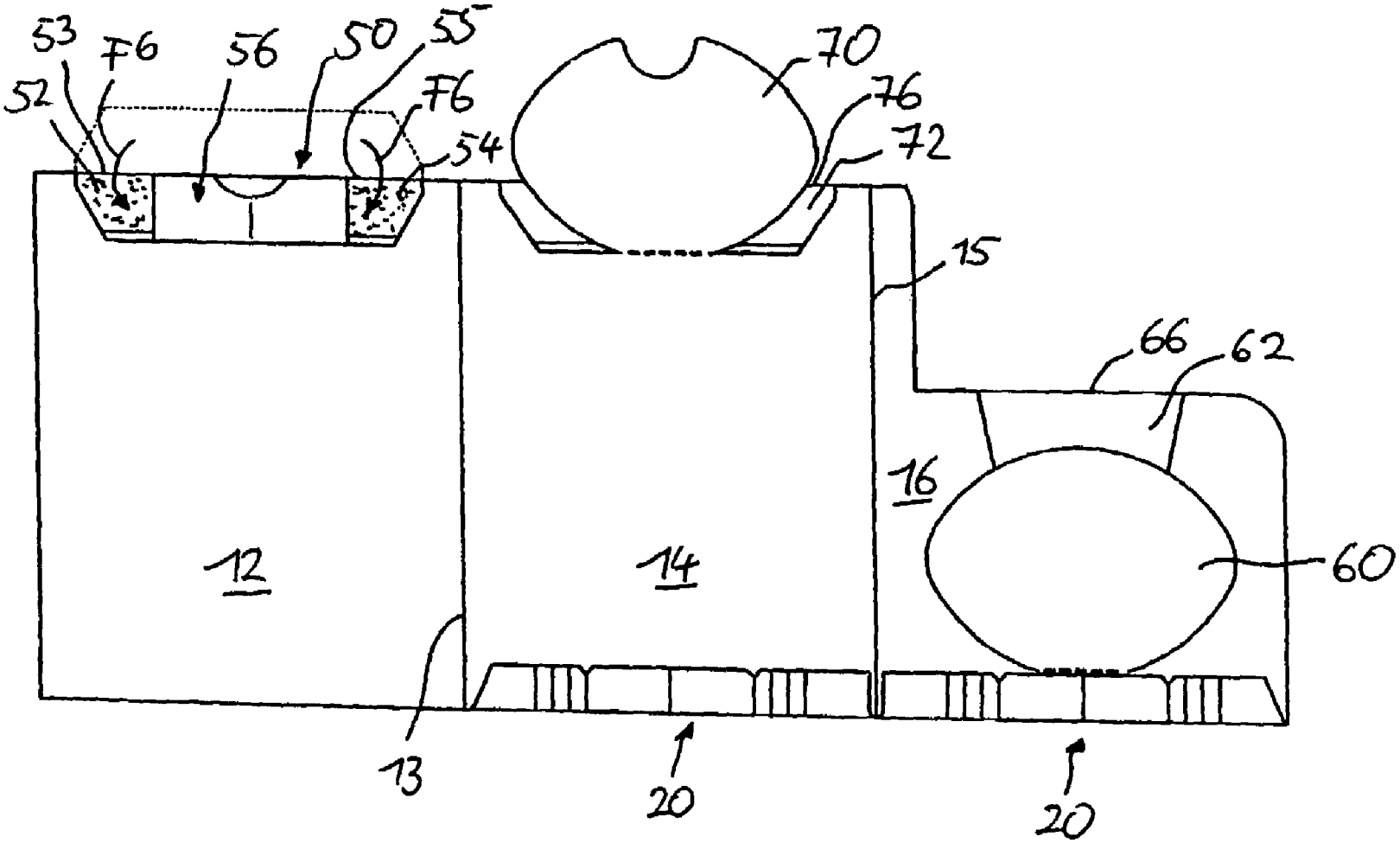

According to FIG. 13, the second supporting unit 50 is then folded inward around the first adhesive tab fold 53 and the second adhesive tab fold 55, the first adhesive tab 52 and the second adhesive tab 54 being adhesively bonded to the inner wall of the first side wall 12 (adhesive areas illustrated dotted, arrows F6).

Figure 14:
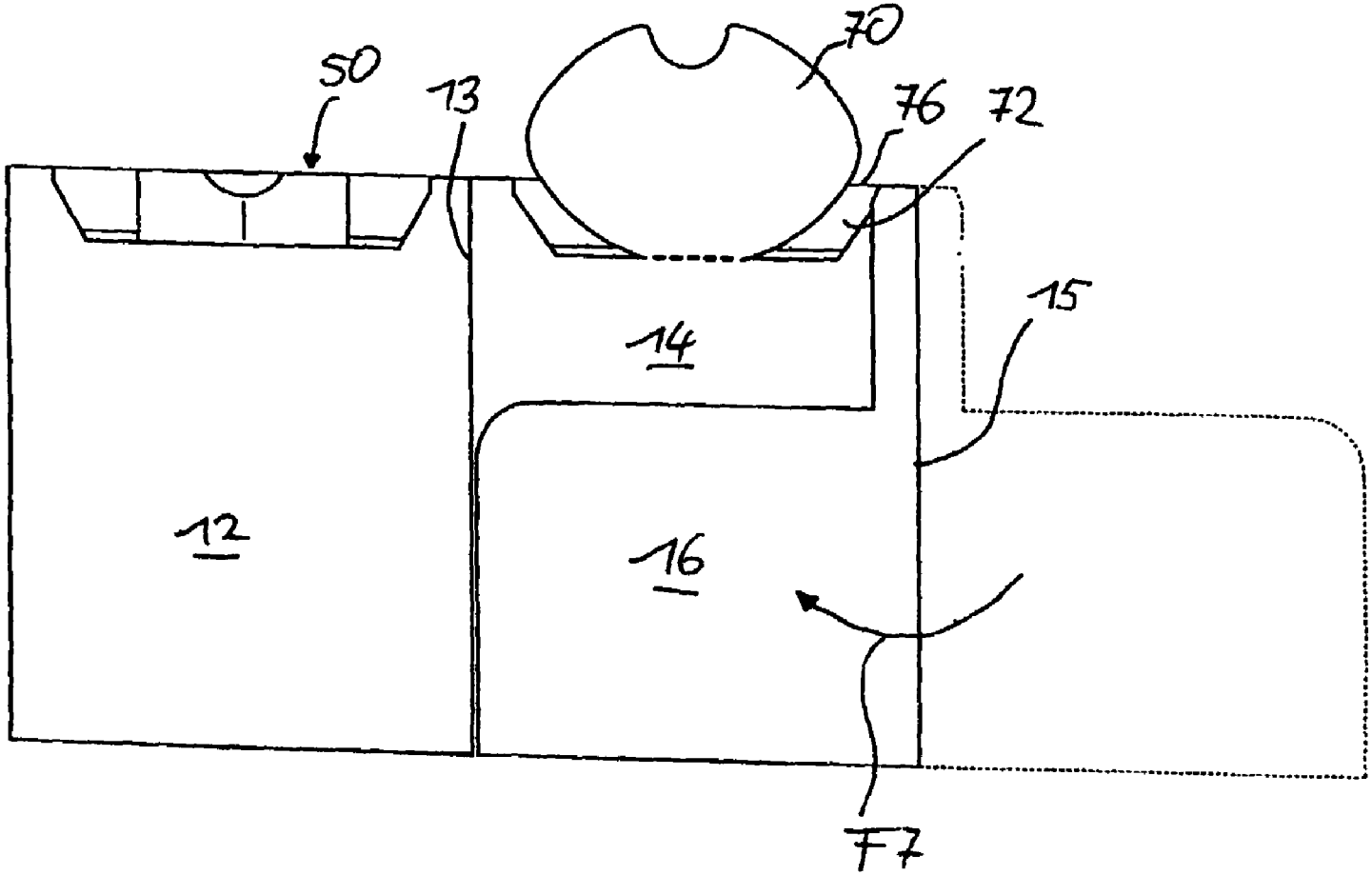

Next, the inner side wall 16 is folded along the second side wall fold 15 onto the inside of the second side wall element 14 (see FIG. 14, arrow F7).

Figure 15:
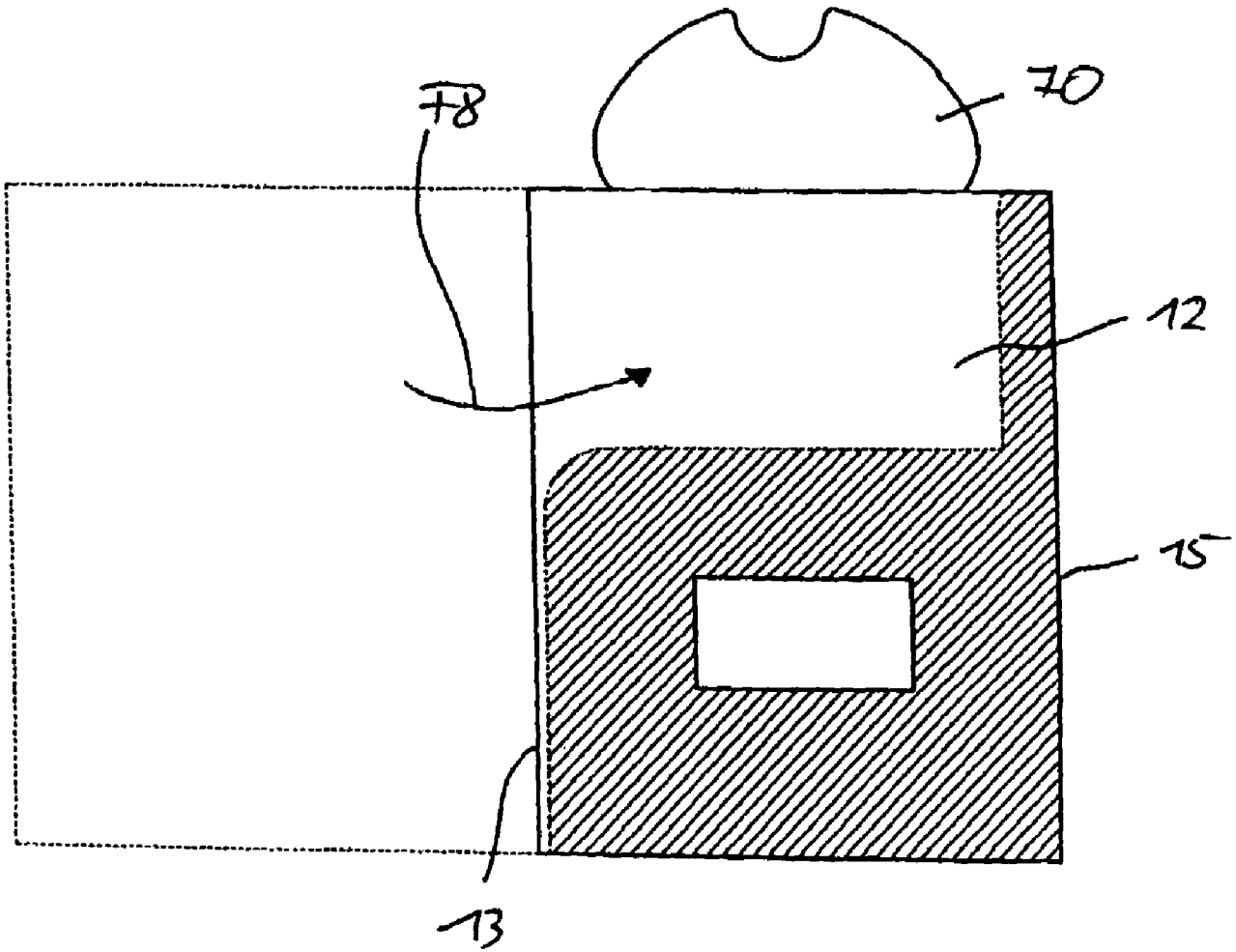

After that, the first side wall 12 is folded around the first side wall fold 13 onto the inner side wall 16 and the second side wall 14 and adhesively bonded to the inner side wall 16 (adhesive area illustrated hatched, arrow F8, see FIG. 15).

Figure 16:
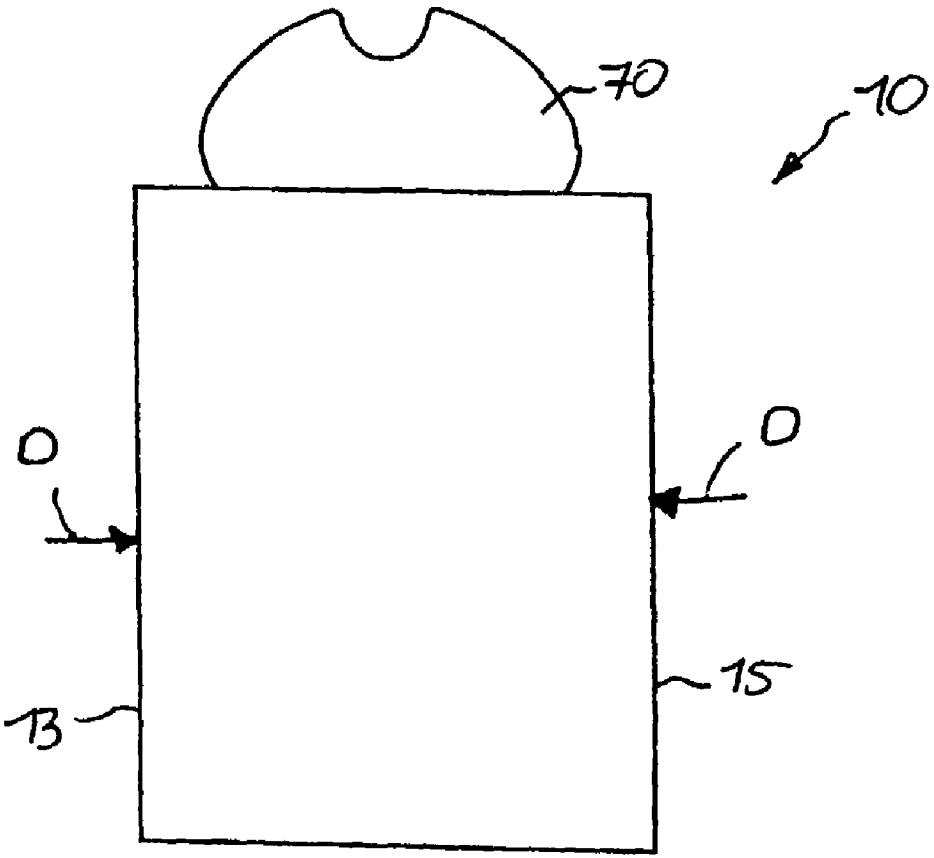

Therefore, the flat-folded transport state of the folded box 10 illustrated in FIG. 16 is reached.

The folded box 10 is folded up completely at the filler by exerting pressure (arrows D according to FIG. 16) on the first and, respectively, second side wall fold 13 and, respectively, 15.

Figure 17:
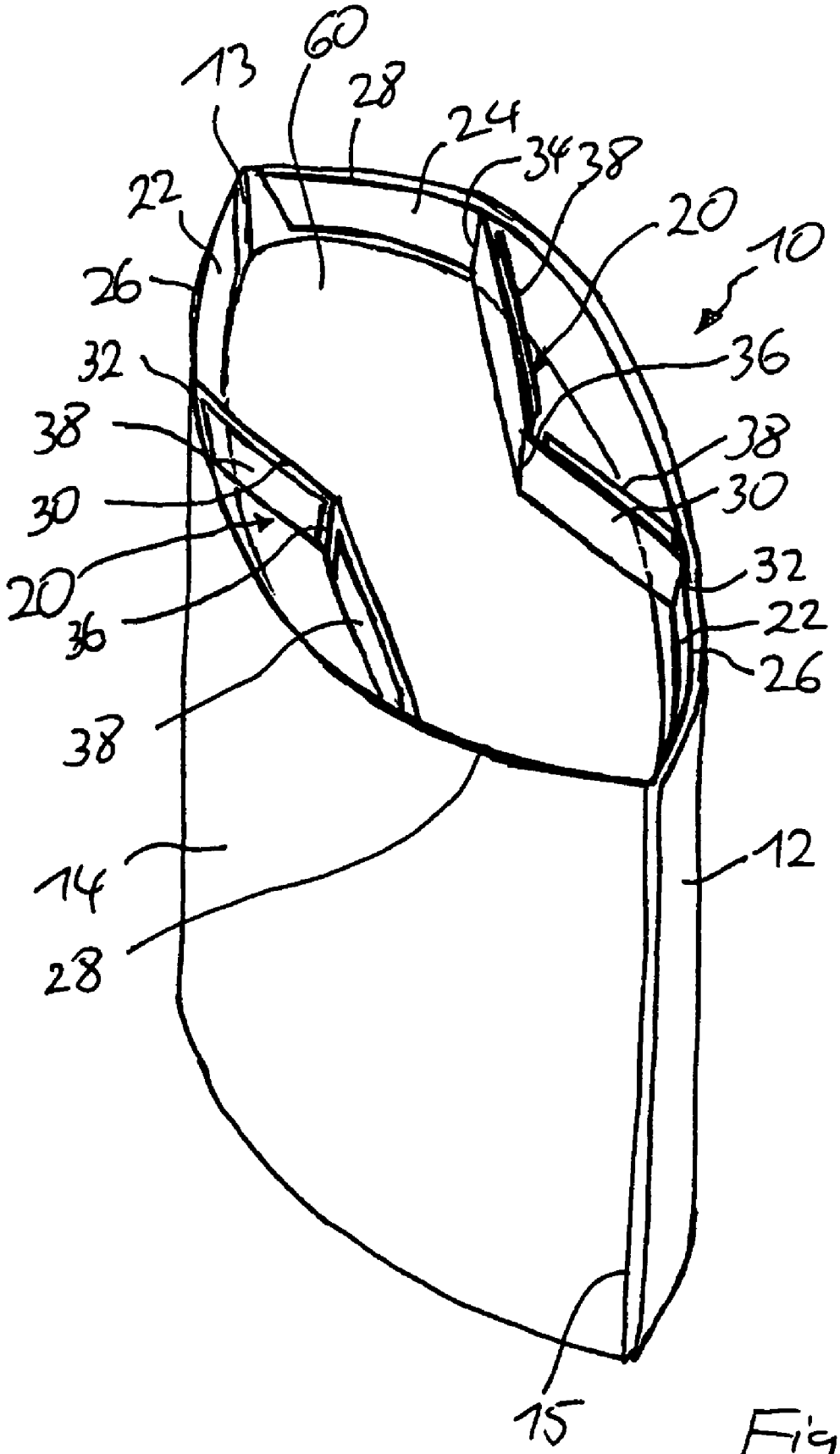
FIG. 17 shows a perspective detailed view of the base area of the folded box folded up from the blank according to FIG. 6, and FIGS. 18 and 19 show a perspective detailed view of the lid area of the folded box folded up from the blank according to FIG. 6 with a different folded state of the supporting unit.

The folded-up base region of the folded box 10 is illustrated schematically in a perspective view in FIG. 17. It can be seen clearly how the two supporting units 20 form supporting tabs 30 folded inward, which serve as a support for the base unit 60. As a result, the base unit 60 can be formed as a single tab. In order to increase the loadbearing capacity, in a design variant which is not illustrated, the base unit can also be double-walled. On account of the relatively high stiffness of the supporting tab 30, because of the reinforcing tabs 38, the supporting tabs 30 automatically fold inward during the folding-up operation of the folded box 10.

Figure 18:
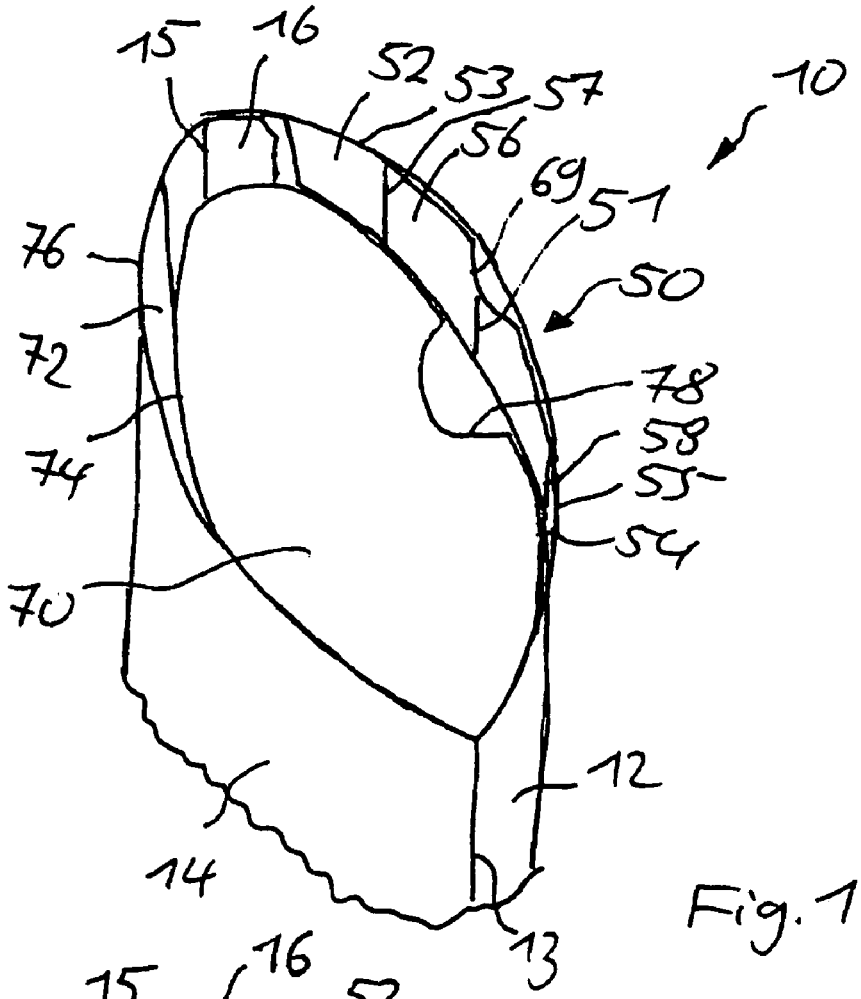
Figure 19:
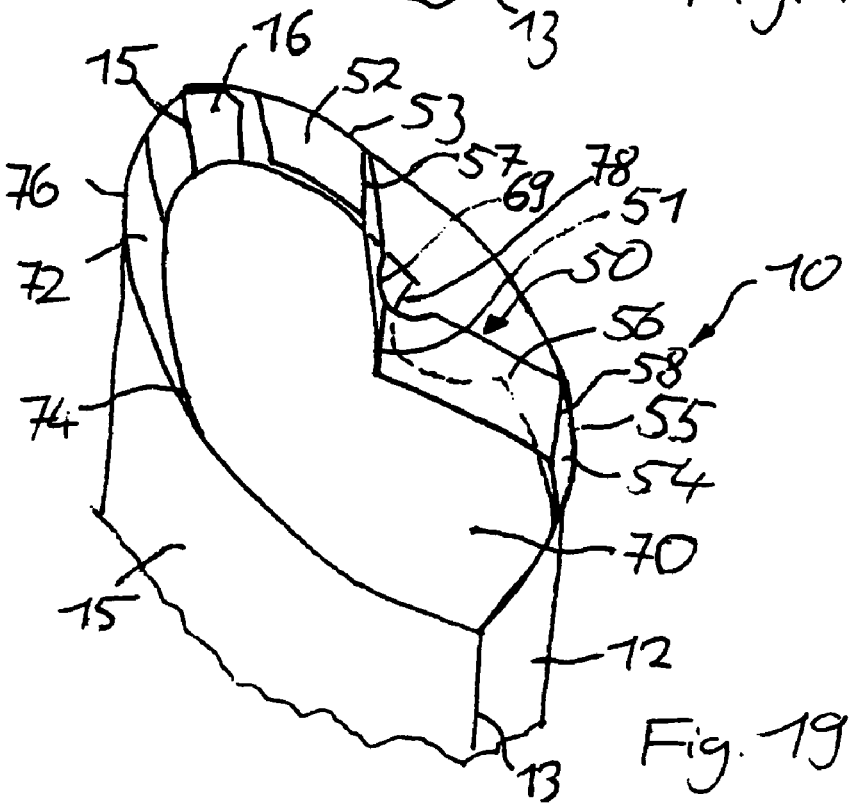

The folded-up lid region of the folded box 10 is illustrated in a detailed perspective view in FIGS. 18 and 19. The supporting unit 50 has a single-walled supporting tab 56 which, on account of its low rigidity, remains nestling against the inner wall of the first side wall 12 when the folded box is folded up. After the folded box has been filled, the lid unit 70 is folded inward about its lid fold 74. This state is illustrated in FIG. 18.

In order to secure the lid unit against unintentional opening, the supporting tab 56 is folded up into the interior of the folded box 10 (see FIG. 19). For the purpose of improved handling of the lid unit 70 during opening, use is made of the cutout 78, behind which it is possible to grip.

The invention claimed is:

1. A folded box having side walls and a base unit and/or a lid unit, at least one of the side walls having a convex curvature when the folded box is folded up, the folded box further comprising at least one supporting unit connected to an inner surface of the convexly curved side wall, the at least one supporting unit having a first adhesive tab and a second adhesive tab connected to the inner surface of the convexly curved side wall and arranged spaced apart from each other in the direction of the curvature; and a supporting tab between the first and second adhesive tab and positioned along the convexly curved sidewall, the supporting tab being connected to the first and the second adhesive tab via a first supporting tab fold and a second supporting tab fold, respectively, the length of the supporting tab corresponding to the distance between the first adhesive tab and the second adhesive tab, wherein, when the folded box is folded up, the supporting tab is adapted to be folded into the interior of the folded box or, when the folded box is folded up, the supporting tab is adapted to fold up automatically into the interior of the folded box.

2. The folded box as claimed in claim 1, further comprising a plurality of supporting units arranged in the direction of the curvature.

3. The folded box as claimed in claim 1, wherein the folded box has two convexly curved side walls which, when folded up, are opposite each other, so that the result is an oval or round cross-sectional shape, and opposite supporting units are arranged on the inside of the side walls.

4. The folded box as claimed in claim 1, wherein the supporting tab has a convex curvature inward when folded up.

5. The folded box as claimed in claim 1, wherein the supporting tab includes at least one further supporting tab fold, the at least one further supporting tab fold being parallel to the first supporting tab fold and the second supporting tab fold and being arranged centrally on the supporting tab.

6. The folded box as claimed in claim 1, wherein the supporting tab comprises double walls.

7. The folded box as claimed in claim 1, wherein the supporting tab is arranged underneath the base unit and/or above the lid unit.

8. The folded box as claimed in claim 1, wherein the base unit and/or the lid unit is connected to the inner surface of the convexly curved side wall via a base fold and a lid fold, respectively, the base fold and lid fold being arranged substantially at the same height as an upper and a lower edge, respectively, of the folded-up supporting tab.

9. The folded box as claimed in claim 8, wherein the base unit and the lid unit are provided with a base adhesive tab and a lid adhesive tab, respectively, the base adhesive tab and the lid adhesive tab being connected to the convexly curved side wall via a base adhesive tab fold and a lid adhesive tab fold, respectively, the base adhesive tab and the lid adhesive tab further adapted to be connected to the inner surface of the convexly curved side wall.

10. The folded box as claimed in claim 1, wherein the first and second adhesive tabs of the supporting unit are integrally molded on a lower and/or upper front end edge of the convexly curved side wall via a first adhesive tab fold and a second adhesive tab fold, the folded box further comprising a slot between the convexly curved side wall and the supporting tab.

11. The folded box as claimed in claim 1, wherein the supporting tab is reinforced by at least one reinforcing tab, the at least one reinforcing tab being connected to the supporting tab via a reinforcing tab fold, the reinforcing tab fold being parallel to the first adhesive tab fold and the second adhesive tab fold.

12. The folded box as claimed in claim 3, wherein the base unit and/or the lid unit have an external circumferential contour which corresponds substantially to an inner circumferential contour, formed by the convexly curved side walls, of the folded box.

13. The folded box as claimed in claim 1, wherein the base unit or the lid unit is double-walled.

14. The folded box as claimed in claim 1, wherein the folded box is composed of board material or plastics material.

15. The folded box as claimed in claim 1, wherein the folded box is formed from a one-piece blank.

16. The folded box as claimed in claim 1, further comprising a slot between the supporting tab and the convexly curved side wall.

* * * * *

UNITED STATES PATENT AND TRADEMARK OFFICE

CERTIFICATE OF CORRECTION

PATENT NO. : 7,578,426 B2
APPLICATION NO. : 10/565269
DATED : August 25, 2009
INVENTOR(S) : Wende et al.

It is certified that error appears in the above-identified patent and that said Letters Patent is hereby corrected as shown below:

On the cover page item [54]:

Replace the title ~~FOLDING BAG~~ with FOLDED BOX

Signed and Sealed this

Twenty-seventh Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,578,426 B2
APPLICATION NO. : 10/565269
DATED : August 25, 2009
INVENTOR(S) : Wende et al.

It is certified that error appears in the above-identified patent and that said Letters Patent is hereby corrected as shown below:

On the cover page item [54] and Column 1, line 1:

Replace the title ~~FOLDING BAG~~ with FOLDED BOX

This certificate supersedes the Certificate of Correction issued October 27, 2009.

Signed and Sealed this

First Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,578,426 B2
APPLICATION NO. : 10/565269
DATED : August 25, 2009
INVENTOR(S) : Wende et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 601 days.

Signed and Sealed this

Seventh Day of September, 2010

David J. Kappos

David J. Kappos
*Director of the United States Patent and Trademark Office*